United States Patent [19]

Behrendt et al.

[11] 4,247,211

[45] Jan. 27, 1981

[54] OPTICALLY CODED KEYBOARD ARRANGEMENT

[75] Inventors: Wolfgang Behrendt; Detlef Bohnhage, both of Wilhelmshaven; Peter Friedemann, Zetel; Bernhard Frölich, Darmstadt; Reinhold Orzessek, Schortens, all of Fed. Rep. of Germany

[73] Assignee: Olympia Werke AG, Wilhelmshaven, Fed. Rep. of Germany

[21] Appl. No.: 16,944

[22] Filed: Mar. 2, 1979

[30] Foreign Application Priority Data

Mar. 4, 1978 [DE] Fed. Rep. of Germany ..... 2809437
Dec. 15, 1978 [DE] Fed. Rep. of Germany ..... 2854203

[51] Int. Cl.[3] ..... B41J 5/08

[52] U.S. Cl. ..... 400/477; 400/478; 340/365 P

[58] Field of Search ..... 400/472, 473, 474, 477, 400/478, 479; 340/365 P

[56] References Cited

U.S. PATENT DOCUMENTS

| | | | |
|---|---|---|---|
| 3,334,237 | 8/1967 | Dodsworth et al. | 400/477 X |
| 3,369,643 | 2/1968 | Avgerinos et al. | 340/365 P X |
| 3,507,995 | 4/1970 | Gianni et al. | 400/477 X |
| 3,588,344 | 6/1971 | Kahanic | 400/477 X |
| 3,612,240 | 10/1971 | Parker | 400/477 |
| 3,614,315 | 10/1971 | Glorioso | 400/477 X |
| 3,777,155 | 12/1973 | Cramer et al. | 400/477 X |
| 4,159,183 | 6/1979 | Johannsen | 400/478 X |

FOREIGN PATENT DOCUMENTS

| | | | |
|---|---|---|---|
| 2636009 | 2/1978 | Fed. Rep. of Germany | 400/477 |
| 2657815 | 6/1978 | Fed. Rep. of Germany | 400/479 |

*Primary Examiner*—Ernest T. Wright, Jr.
*Attorney, Agent, or Firm*—Spencer & Kaye

[57] ABSTRACT

An optically coded keyboard arrangement has a plurality of key units arranged to be individually actuated; an actuation sensing arrangement that includes a plurality of light emitters generating light beams and a plurality of detectors each placed in the path of a respective light beam. Each key unit includes a key arranged to be depressed and a coded mask coupled to the key for movement with the key in unison upon displacement of the key and for movement relative to the key in a direction transverse to the path of motion of the key. Each key unit further has a switching spring which, in the position of rest of the associated key has an arcuate shape bulging in one direction and engages at one end a countersupport. As the key is depressed, the switching spring is deformed into a more bulging shape, carrying the mask into a position where it is ready to interrupt the light beams. Upon continuing movement of the key by virtue of the depressing force, a cam causes the tensioned switching spring to jump off the countersupport, whereupon the spring, as it assumes a released state, rapidly moves the mask into the light beam paths.

11 Claims, 9 Drawing Figures

FIG. 1a
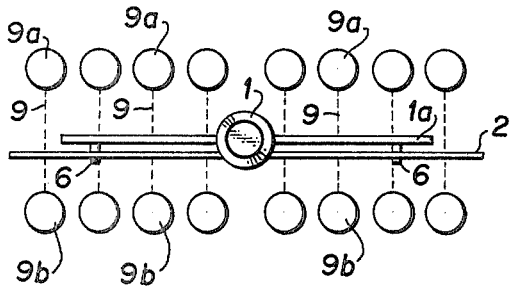
FIG. 1b
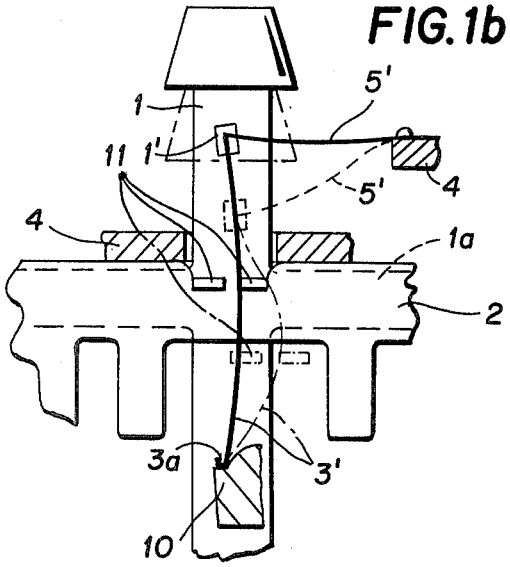
FIG. 6
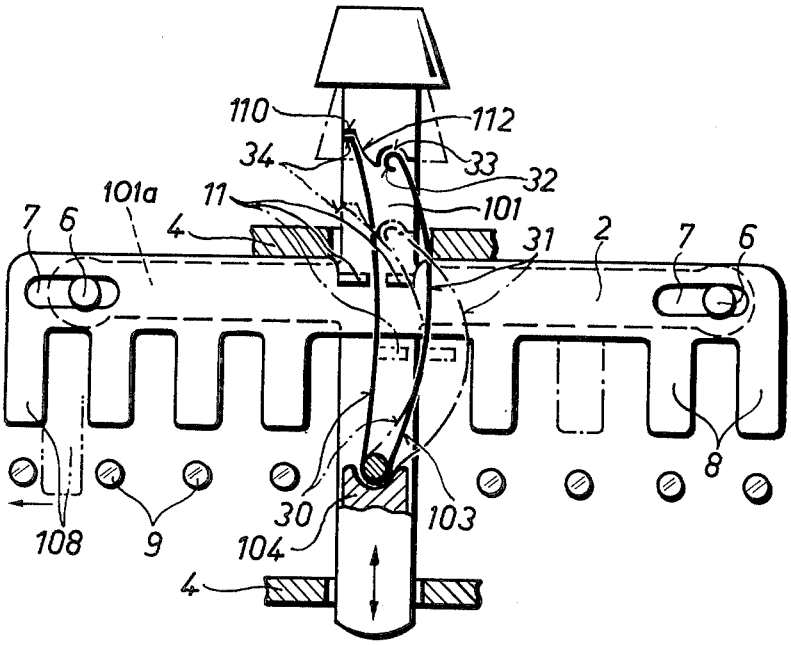
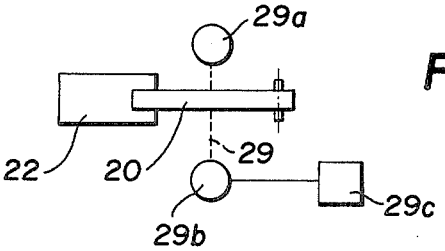
FIG. 5a

OPTICALLY CODED KEYBOARD ARRANGEMENT

BACKGROUND OF THE INVENTION

This invention relates to an optically coded keyboard arrangement for typewriters or similar office machines. To each key there is coupled a displaceably supported mask which can be shifted in a closed-curve path in the direction of the motion of the key and perpendicularly thereto. Each mask is actuated independently of the actuating speed of the associated key for performing a switching motion during which the mask, for a short period, interrupts or allows to pass through light beams between respective light sources and light detectors in accordance with the coded configuration of the mask. A separate switching spring is connected with each mask and is adapted to be bent through by the respective key upon actuation of the key.

In United States Patent Application Ser. No. 847,738, filed November 2nd, 1977 by Fred Johannsen, now U.S. Pat. No. 4,159,183, issued June 26th, 1979, there is disclosed an optically coded keyboard arrangement wherein on the machine frame there are arranged guide means with oblique camming faces which determine a closed geometrical path for the respective mask. Upon depressing and releasing a key, a guide pin secured to the respective mask glides along the oblique camming faces. The leaf spring-like switching spring which is, at one end, affixed to the key and is, in its middle, connected with the mask, is slidable at its free end in a guide fork. Upon motion of the key, the switching spring is tensioned by the guide means in opposite directions.

SUMMARY OF THE INVENTION

It is an object of the invention to provide an improved optically coded keyboard arrangement of the above-outlined type which is of simplified construction.

This object and others to become apparent as the specification progresses, are accomplished by the invention, according to which, briefly stated, the switching spring which, in the position of rest of the associated key has an arcuate shape bulging in one direction, engages at one end a countersupport. As the key is depressed, the switching spring is deformed into a more bulging shape, carrying the mask into a position where it is ready to interrupt the light beams. Upon continuing movement of the key by virtue of the depressing force, a cam causes the tensioned switching spring to jump off the countersupport, whereupon the spring, as it assumes a released state, rapidly moves the mask into the light beam paths.

The optically coded keyboard arrangement according to the invention has a small number of components which, particularly in an integrated structural construction, results in a reduced spatial requirement and in a simplification of the manufacture, eventually leading to a reduction of the overall costs. The keyboard arrangement according to the invention requires only slight forces and distinguishes itself with short switching periods and a high degree of reliability.

BRIEF DESCRIPTION OF THE DRAWING

FIG. 1*a* is a schematic top plan view of the structure shown in FIG. 1.

FIG. 1*b* is a fragmentary side elevational view of the preferred embodiment, including a modified part.

FIG. 5*a* is a schematic bottom plan view of the structure shown in FIG. 5.

FIG. 6 is a side elevational view of still another preferred embodiment of the invention, depicting the structure in its position of rest.

DESCRIPTION OF THE PREFERRED EMBODIMENTS

Figure 1:
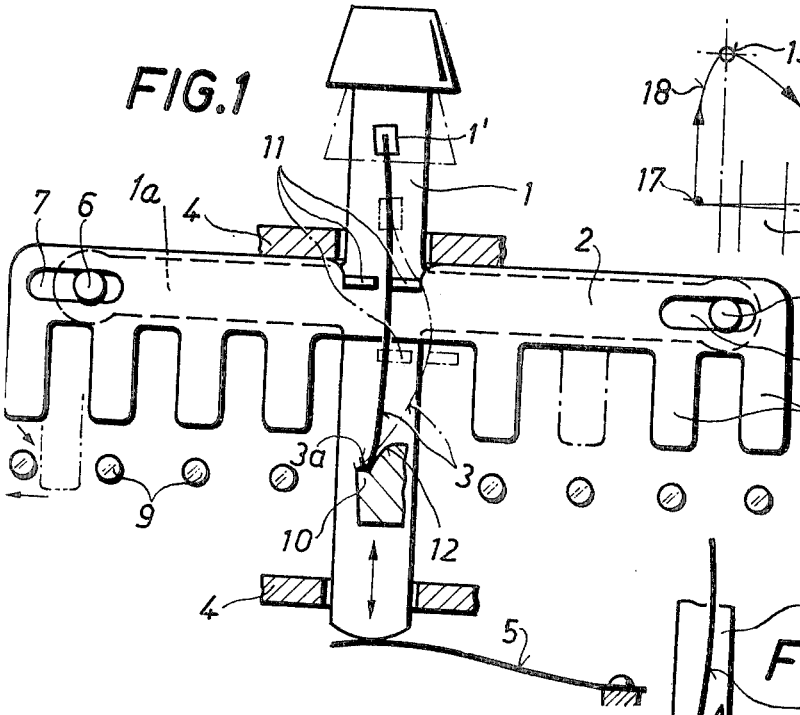
FIG. 1 is a side elevational view of a preferred embodiment of the invention, depicting the structure in its position of rest.

Turning now to FIG. 1, there is shown one key unit of an optically coded keyboard arrangement for typewriters or similar office machines. Each key unit comprises a key 1, a mask 2 and a switching spring 3 structured to be resilient to bending. The key 1 is supported in a machine frame 4 in such a manner that it is displaceable in the vertical direction against the force of a return spring 5. The key 1 has a transverse arm 1*a* which, at opposite ends, carries two pins 6. The mask 2 has two horizontal slots 7 into which extend respective pins 6 of the key 1. The mask 2 is thus supported by the key 1 in such a manner that the mask 2 is, for performing a switching motion, movable in the horizontal direction with respect to the key 1, but is form-lockingly connected with the key 1 regarding the actuating direction (vertical displacement) of the latter. The mask 2 is thus displaceable in a closed-curve path both in the direction of the key motion and perpendicularly thereto. The mask 2 has one or a plurality of tabs 8 which may be selectively broken off at their base for initial individual coding. Also referring to FIG. 1*a*, upon motion of the key 1, the tabs 8 are positioned in the light beam paths 9 between the respective light sources 9*a* and light detectors 9*b* and thus block the latter in accordance with the code determined by the position and spacing of the remaining tabs 8 on the mask 2 for conventionally actuating the respective character.

The leaf-like switching spring 3 is attached at 11 its upper end to the key 1 and engages with its lower, hook-like bent end 3*a* a countersupport 10 which is affixed to the machine frame 4. The switching spring 3 serves as a drive means for the mask 2 which, for this purpose, has two spaced lugs 11 bent out of the plane of the mask 2 and flank the switching spring 3 approximately in its middle. In the monostable initial position shown in solid lines, the switching spring 3 has a unilaterally arcuate configuration. The countersupport 10 has a camming part 12 situated at the outwardly bulging side of the switching spring 3.

Turning now to FIG. 1*b*, according to a further advantageous embodiment, the switching spring and the return spring are combined into a single L-shaped spring which is attached to the key 1 at the intersection of its two spring legs 3' and 5'. In such an arrangement the spring leg 3' serves as the drive means for the mask 2, whereas the leg 5' which is tensioned in the machine frame 4 serves as the return spring for the key 1.

Upon depressing the key 1 into its phantom-line position shown in FIG. 1, the switching spring 3 engaging the countersupport 10 is bent through towards the right and thus carries with it the mask 2 by virtue of the interengagement between the switching spring 3 and the right-hand lug 11. The bent-through switching spring 3 now engages the camming part 12 and by so doing, the hook-shaped terminus 3*a* of the switching spring 3 is shifted towards the left until it suddenly slides (jumps) off the countersupport 10. Just before the switching spring 3 jumps off the countersupport 10, the mask 2 has arrived, after an obliquely oriented travel downward and towards the right, in a position in which the tabs 8 of the mask 2 are situated towards the right adjacent the respective beam paths 9 as illustrated in dash-dotted lines for the left-hand tab 8. As soon as the switching spring 3 jumps off the counter support 10, the switching spring 3 abruptly assumes its relaxed state and carries with it the mask 2 towards the left, by virtue of the engagement of the switching spring 3 with the left-hand lug 11 of the mask 2. During this abrupt switching motion in the normal actuating position (single function mode) of the key 1, the tabs 8 of the mask 2 traverse the beam paths 9 from the right towards the left.

As the operator (typist) release the key 1, the return spring 5 moves the key 1 and thus the mask 2 back upwardly into the initial position in which the switching spring 3 is again in engagement with the countersupport 10. Thus, during operation, the mask 2 describes a closed, partially curvilinear path. Since the mask 2 does not transmit any forces during its switching motion, it may be made of a material of slight mass such as film or synthetic material, a thin metal sheet or the like.

Figure 2:
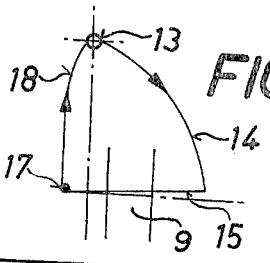
FIG. 2 is a diagram illustrating the path of motion of a component of the FIG. 1 embodiment during operation.

The closed curve travel of each mask 2 during operation will now be summarized with reference to FIG. 2 which illustrates the path traveled by the masks 2. The initial position (position of rest) of the mask 2 is designated at 13. Upon depressing the key 1, the mask 2 moves along a path 14 downwardly towards the right, as a result of which the mask tabs 8 are situated adjacent the light beam paths 9. As the switching spring 3 jumps off its countersupport 10, there occurs the abrupt motion of the mask 2 along a path 15 towards the left, during which the mask 2 interrupts the beam paths 9 for a short period. The position of the mask 2 in the normal actuating position of the key 1 is indicated at 17. Upon releasing the key 1, the mask 2 moves along a path 18 back upwardly into the initial position 13.

Figure 3:
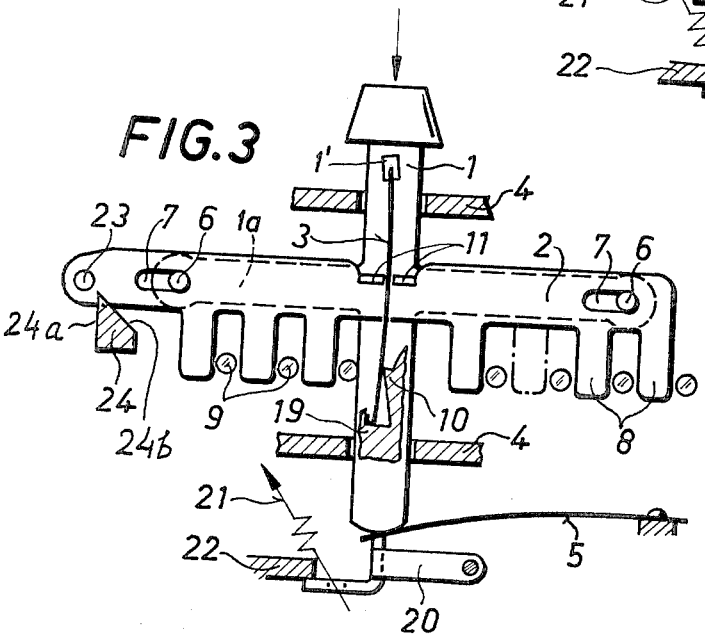
FIG. 3 is a side elevational view of another preferred embodiment, showing the structure in a single function mode.

Turning now to FIG. 3, a second countersupport 19 may be arranged in the path of motion of the switching spring 3. Thus, the switching spring 3, after having jumped off the first countersupport 10, engages the second countersupport 19 in the normal actuating position of the key 1 and is locked by the two countersupports 10 and 19. In this manner the mask 2 is prevented from traversing the light beam paths 9 anew.

The keyboard arrangement described above makes possible, in a further advantageous embodiment of the invention, the performance of a repeating operation (repeat function mode). For this purpose the key 1 is, from its normal actuating position shown in solid lines in FIG. 3, displaceable into a repeat function position in which the switching spring 3 is, by virtue of its engagement with the second countersupport 19, once more buckled towards the right in the same direction. During this occurrence, the mask 2 is carried by the lugs 11 and the tabs 8 are brought permanently into the light beam paths 9, so that until the key 1 is released, one or more repeating functions are performed.

In the normal actuating position, the key 1 engages a pressure point rail 20 which, urged by an upwardly directed force of a spring 21, engages an abutment 22 which is affixed to the machine frame 4. Upon depressing the key 1 from its normal operating position into the position corresponding to the repeat function, the rail 20 is swung downwardly, whereby the spring 21 is tensioned. The attainment of the pressure point or passing therebeyond is thus positively noticeable by the typist.

In order to achieve a sudden displacement of the switching spring 3 and thus the mask 2 during the repeat function of the key 1, on the mask 2 there is arranged a pin 23 cooperating with a cam 24 affixed to the machine frame 4. When the key 1 is depressed from the normal actuating position (single function mode) towards the repeating position (repeat function mode), the pin 23 slides along the face 24*a* of the cam 24 downwardly. As a result, the switching spring 3 is deformed to assume an "S" shape. As the key 1 arrives into the repeat position, the pin 23 has passed beyond the cam face 24*a*. This permits the mask 2 to move rapidly towards the right as urged by the tensioned switching spring 3 and as a result, the tabs 8 of the mask 2 block the light beam paths 9 in accordance with the respective code. As the key 1 is released, it is again lifted by the return effect of the spring 21 of the pressure point rail 20 and the return spring 5, whereby the arcuate switching spring 3 is released, causing it to straighten. The force thus released by the switching spring 3 moves the mask 2 towards the left. During this occurrence, the pin 23 of the mask 2 slides along the oblique face 24*b* of the cam 24 upwardly until the key 1 has again reached its normal actuating position. It is thus seen that again, the mask 2 moves along a closed-curve path when the key 1 moves from the position of normal function into the position of repeat function and back. During the remainder of the return motion of the key 1 into its initial position which is effected now only by the return spring 5, the mask 2 describes the same return path through which it passes during the earlier-described normal (single function) operation.

Figure 4:
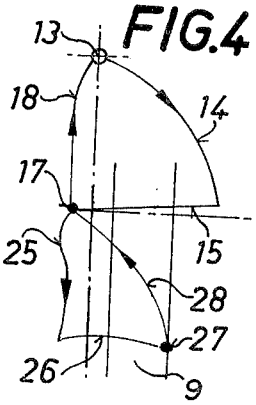
FIG. 4 is a diagram illustrating the path of motion of a component of the FIG. 3 embodiment.

The closed-curve travel of each mask 2 for performing the repeat function will now be summarized with reference to FIG. 4. For a single function operation, the mask 2 moves along the paths 14 and 15 as it has been described earlier in connection with FIG. 2 and assumes the location designated at 17 in the normal actuating position (single function mode) of the key 1. Upon further depression of the key 1, the mask 2, guided by the cam face 24*a*, moves downwardly along a path 25. At the end of the path 25 the cam 24 releases the mask 2 which, by virtue of the tensioned switching spring 3, is abruptly moved towards the right along a path 26 and, in the repeat function position 27, interrupts the light beam paths 9 according to the code assigned to that key 1. Upon releasing the key 1, the mask 2, guided by the cam face 24*b*, moves along a path 28 into the normal actuating position 17 and therefrom into the initial position 13 along the path 18.

Figure 5:
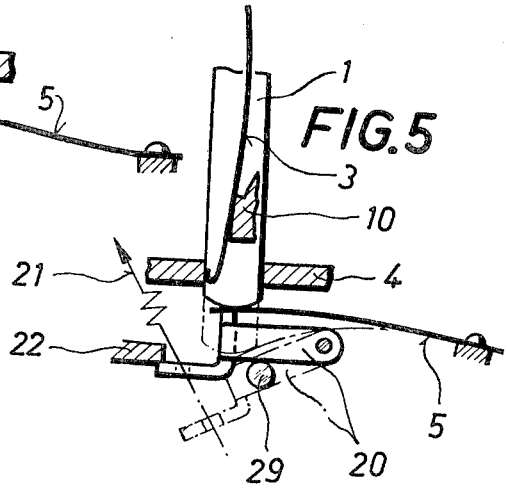
FIG. 5 is a fragmentary side elevational view of another preferred embodiment of the invention.

The embodiment illustrated in FIGS. 5 and 5*a* makes possible the performance of a repeat function without the provision of a second countersupport for the switching spring 3 and without a guiding cam for the mask 2, as it was the case in the FIG. 3 embodiment. In the embodiment according to FIG. 5, with the pressure point rail 20 there is associated an additional light source 29*a* which emits a light beam 29 whose light detector 29*b* which is actuated upon a rocking motion of the pressure point rail 20, is connected to a control device, such as a microprocessor 29*c*, for a repeated reproduction of the same character (repeat function mode).

In the embodiments described above, the switching spring 3 structured to be elastic to bending, is shown as being a structural component connected with the respective key 1. According to a further advantageous embodiment, the switching spring 3 is of synthetic material and is integral with the key 1, for example, as a result of injection molding. Thus, in such an arrangement, the switching spring 3 forms a unitary one-piece member with the key 1.

Turning now to FIG. 6, there is illustrated a further embodiment of a key unit of the optically coded keyboard arrangement, shown in side elevation in its initial position (position of rest). The countersupport 110 and the camming part 112 are, in this embodiment, integral with the key 101 and thus form therewith a movable component. The spring 103 has the shape of a hair pin and is tensioned in the machine frame 104. Its left-hand leg 30 serves as the switching (mask shifting) spring which is force-transmittingly coupled to the mask 2 by means of lugs 11 in a manner as described in connection with the FIG. 1 embodiment. The pin-and-slot connection between an arm 101*a* of the key 101 and mask 2 is also identical to the FIG. 1 embodiment. The right-hand leg 31 of the hair pin spring 103 constitutes the return spring for the key 101 and has a bent portion 32 which engages into a depression 33 of the key 101.

In the initial position as shown in solid lines in FIG. 6, the two legs 30 and 31 of the hair pin spring 103 are arcuate towards the same side. Upon depression of the key 101 into its phantom-line position, the two legs 30, 31 of the hair pin spring 103 are bent through towards the right. During this occurrence, the left-hand leg 30 carries the mask 2 towards the right. As a result, the mask 2 assumes a position in which the tabs 8 of the mask 2 are situated adjacent and to the right of the respective light beam paths 9 as it is illustrated for the left-hand tab 108 in dash-dotted lines. Upon further downward movement of the key 101, the bent-through left-hand leg 30 engages the camming part 112 of the key 101. This occurrence causes the hook-like leg terminus 34 engaging the countersupport 110 to shift towards the left until the terminus 34 jumps off the countersupport 110. As a result, the left leg 30 of the hair pin spring 103 straightens out and assumes an untensioned state, carrying the mask 2 with it towards the left. During this abrupt switching motion into the actuating position of the key 101, the tabs 8, 108 of the mask 2 traverse the light beam paths 9 from the right towards the left, so that the light path 9 is interrupted for a short period independently from the kind and duration of the motion of the key 101.

As the typist releases the key 101, the tensioned right-hand leg 31 of the hair pin spring 103 returns upwardly the key 101 and the mask 2. In the initial position of the key 101, the left-hand leg 30 of the hair pin spring 103 again engages, with its terminus 34, the countersupport 110 of the key 101. As it has been described in connection with the embodiment of FIG. 1, the mask 2 travels along the closed geometrical curved path 14, 15 and 18 (FIG. 2).

It is to be understood that the above description of the present invention is susceptible to various modifications, changes and adaptations and the same are intended to be comprehended within the meaning and range of equivalents of the appended claims.

What is claimed is:

1. In an optically coded keyboard arrangement formed of a plurality of key units arranged to be individually actuated; actuation sensing means including a plurality of light emitters generating light beams and a plurality of detectors each placed in the path of a respective light beam; each key unit including a key arranged to be depressed from a position of rest, a coded mask, coupling means connecting the mask to the key for movement with the key in unison upon displacement of the key and for movement relative to the key in a direction transverse to the path of motion of the key, and mask actuating means for moving the mask into the path of the light beams upon depression of the key independently of the speed of the key; the improvement wherein each key unit comprises a switching spring having opposite first and second ends; a first and a second support for engaging the first and second spring ends, respectively; one of said supports being affixed to the key and the other of said supports being held stationarily; in said position of rest of said key said switching spring being in engagement with both said supports and assuming a monostable intial state in which said switching spring has an arcuate course towards one spring side; said switching spring being bent further in the direction of said one spring side upon said supports approaching one another during depression of said key; one of said supports being a countersupport having a spring-engaging surface engageable by said first spring end; a camming means situated adjacent said spring on said one spring side for engaging said spring and causing said first spring end to jump off said spring-engaging surface when said key attains a predetermined depressed state; and means coupling said switching spring with said mask for carrying said mask into the path of said light beams of said switching spring as said switching spring relaxes upon jumping off said countersupport; said switching spring being included in said mask actuating means.

2. An optically coded keyboard arrangement as defined in claim 1, wherein said countersupport is a first countersupport; further comprising a second countersupport situated next to said first countersupport for receiving said first spring end as said first spring end jumps off said first countersupport and for preventing said switching spring from repeated flexing.

3. An optically coded keyboard arrangement as defined in claim 1, wherein said key has a first depressed position corresponding to a single function mode of operation in which said first spring end jumps off said countersupport and further wherein said key has a second depressed position corresponding to a repeat function mode of operation; the improvement further comprising repeat function actuating means responding when said key reaches the said second depressed position; a pressure point rail displaceably supported in the path of motion of each key to be contacted by a key in the first depressed position thereof; an abutment; and a rail spring urging said pressure point rail towards said abutment against the depressing force exerted on the keys, whereby upon pressing a key beyond said first depressed position towards said second depressed position said pressure point rail is displaced by the respective key, overcoming the force of said rail spring.

4. An optically coded keyboard arrangement as defined in claim 3, wherein said countersupport is a first countersupport; further comprising a second countersupport situated next to said first countersupport for receiving said first spring end as said first spring end jumps off said first countersupport; said switching spring being arranged for moving said mask into and past said light beams upon movement of said switching spring as said first spring end jumps off said first countersupport onto said second countersupport; said switching spring being bent in the direction of said one spring side upon said second countersupport and said second support approaching one another during depression of said key from said first depressed position into said second depressed position, whereby said mask is brought into said light beam paths by said switching spring.

5. An optically coded keyboard arrangement as defined in claim 4, further comprising an additional camming means operatively connected with said mask for preventing said mask from being moved by said switching spring into the path of said light beams during a part of the displacement of said mask and said key from said first depressed position towards said second depressed position of said key and for abruptly releasing said mask when said key has reached its said second depressed position.

6. An optically coded keyboard arrangement as defined in claim 3, further comprising an additional light source for generating an additional light beam and an additional detector arranged in the path of the additional light beam for effecting an operation in the repeat function mode as long as the additional detector is dark; said second light beam being arranged adjacent said pressure point rail and being oriented such that said pressure point rail is moved into the path of said additional light beam and interrupts said additional light beam upon displacement of said key from said first depressed position into said second depressed position.

7. An optically coded keyboard arrangement as defined in claim 1, wherein said switching spring and said key form a one-piece component of synthetic material.

8. An optically coded keyboard arrangement as defined in claim 1, wherein said second support is affixed to said key and further wherein said countersupport and said camming means are affixed to a frame component for stationary positioning.

9. An optically coded keyboard arrangement as defined in claim 1, wherein said second support is affixed to a frame component for stationary positioning and further wherein said countersupport and said camming means are affixed to said key.

10. An optically coded keyboard arrangement as defined in claim 1, further comprising a hair pin-shaped spring having first and second legs connected to one another; said first leg constituting said switching spring and being connected to said second leg at said second end; a third support situated adjacent said countersupport for engaging a free end of said second leg; said second leg constituting a return spring urging said key into said position of rest.

11. An optically coded keyboard arrangement as defined in claim 10, wherein said second support is affixed to a frame component for stationary positioning and further wherein said countersupport, said camming means and said third support are affixed to said key.

* * * * *